US005080206A

United States Patent [19]

Tawil

[11] Patent Number: 5,080,206

[45] Date of Patent: Jan. 14, 1992

[54] ATTACHE CASE INCLUDING EXPANDING GUSSET

[76] Inventor: Abraham I. Tawil, 2334 Ocean Parkway, Brooklyn, N.Y. 11223

[21] Appl. No.: 318,504

[22] Filed: Mar. 2, 1989

Related U.S. Application Data

[63] Continuation of Ser. No. 122,835, Nov. 19, 1987, abandoned.

[51] Int. Cl.[5] ..... A45C 3/02; A45C 7/00; A45C 13/30

[52] U.S. Cl. ..... 190/103; 190/22; 190/125; 190/900; 383/2

[58] Field of Search ..... 190/103, 104, 105, 21, 190/22, 900, 901, 902; 383/2

[56] References Cited

U.S. PATENT DOCUMENTS

| | | | |
|---|---|---|---|
| 924,172 | 6/1909 | Merzbach | 190/103 X |
| 1,329,574 | 2/1920 | Axelman et al. | 190/902 X |
| 1,341,099 | 5/1920 | Abramson | 190/103 |
| 1,806,246 | 5/1931 | Feldman et al. | 190/103 |
| 2,002,878 | 5/1935 | Belber | 190/103 |
| 2,473,489 | 6/1949 | Kaplan | 190/103 X |
| 2,555,820 | 6/1951 | Satz | 190/125 |
| 2,907,420 | 10/1959 | Doppelt | 190/103 |
| 4,128,150 | 12/1958 | Popkin et al. | 190/103 |
| 4,356,899 | 11/1982 | Tawil | 190/103 |
| 4,366,886 | 1/1983 | Tawil | 190/103 |

FOREIGN PATENT DOCUMENTS

| | | | |
|---|---|---|---|
| 943833 | 3/1949 | France | 150/107 |
| 259093 | 10/1926 | United Kingdom | 190/21 |

*Primary Examiner*—Sue A. Weaver
*Attorney, Agent, or Firm*—Ezra Sutton

[57] ABSTRACT

The invention provides an attache case having an improved expansion gusset, wherein the expansion gusset includes cutouts or slots through which elastic or non-elastic straps extend to provide an improved construction for expanding the volume of the attache when needed.

13 Claims, 5 Drawing Sheets

ATTACHE CASE INCLUDING EXPANDING GUSSET

This application is a continuation of application Ser. No. 122,835, filed Nov. 19, 1987 abandoned.

FIELD OF THE INVENTION

The invention relates to attache cases, and more particularly, to an attache case which includes an improved expansion gusset for expanding the capacity of the attache case when needed.

BACKGROUND OF THE INVENTION

Typically, such attache cases include first and second relatively movable sections or compartments, with at least one of the sections having an expansion gusset for expanding the capacity of the attache case. It is well known that an expansion gusset is movable between a closed position and an expanded position and to move the expansion gusset to its expanded position, it can be done manually or by squeezing enough materials into the attache case that it is forced to automatically expand to its expanded position.

Examples of patents which relate to attache cases with expansion gussets are U.S. Pat. Nos. 4,356,899 and 4,366,886 which disclose fastening arrangements that include snap fasteners, fixed fasteners, elastic and non-elastic straps, and straps with slack sections and elastic sections overlapping the interior of the expansion gusset. U.S. Pat, No. 2,555,820 discloses a briefcase that has a bellow section in which leather straps pass around the bellow section and through a slot in each side of the outer frame of the briefcase and then extend inwardly thereof. U.S. Pat. Nos. 1,341,099 and 1,806,246 show the concept of straps extending around a gusset. U.S. Pat. Nos. 2,473,489 and 4,128,150 disclose the use of expandable gussets without straps. Also, U.S. Pat. No. 2,002,878 to Belber discloses an expanding case having a telescoping action.

Referring to FIG. 1, there is shown a typical prior art arrangement of an attache case which has elastic straps for maintaining the expansion gusset in its closed position. The elastic straps are able to expand an amount at least equal to the expansion distance of the expansion gusset. As will be noted, the attache case 10 includes first and second sections 12, 14 relatively movable with respect to each other for opening and closing the attache case. The expansion gusset 16 is shown located in movable section 14 and includes a vinyl strip 18 facing the exterior of the case and is covered on the interior of the case by liner 20. The gusset 16 is held in its closed position by fastening means 22. Usually there are four such fastening means 22 disposed on the sidewalls 14*a* of the case. Such prior art fastening means 22 typically included an elastic strap 24 having a fixed fastening means, such as a rivet 26 at one end thereof on one side of the expansion gusset 16, and another fixed fastening means, such as a rivet 28, on the other end of the elastic strap 24 on the other side of the expansion gusset 16. In operation, when the attache case is expanded to its full capacity, due to content loading or being overstuffed, the expansion gusset 16 moves into its expanded position, thereby also expanding the elastic straps 24 in a vertical direction in an amount at least equal to the expansion distance of the expansion gusset 16. A major drawback to this arrangement is the interference between the expansion gusset 16 and the elastic straps 24, wherein the elastic straps inhibit the free expansion and contraction of theexpandable gusset 16.

The prior art also discloses the use of non-elastic straps and releasable fasteners instead of rivets. Also, the gussets may be mounted on the inside wall or outside wall of the case.

SUMMARY OF THE INVENTION

Briefly, in accordance with the principles of the present invention, there is provided an improved fastening arrangement for the expansion gusset of an attache case. More particularly, the attache case includes first and second sections or compartments relatively movable with respect to each other for opening and closing the attache case. At least one of the first and second sections includes an expansion gusset having cutouts or slots through which elastic or non-elastic straps extend for expanding the capacity of the attache case,; with the expansion gusset being movable between a closed position and an expanded position. In this invention, the elastic straps may have fixed fasteners or snap fasteners that are attached to the inner wall of the movable section of the attache case. These elastic straps expand an amount at least equal to the expansion distance of the expansion gusset. With non-elastic straps, there should be at least one releasable fastener on each strap.

Advantageously, as a result of the present invention, the problem of the prior art is avoided by extending the elastic or non-elastic straps through slots formed in the expansion gusset, thereby eliminating the interference problem between the expansion gusset and the straps. Also, where elastic straps are employed, there is no undue force applied to the fasteners. Another benefit of the present invention is that when the expansion gusset is closed or fully expanded, it cannot be seen from the exterior because of an exterior wall. Further, when the movable section of the case telescopes away from the base of the attache case, the base extends beyond the edge of the exterior wall of the attache case.

BRIEF DESCRIPTION OF THE DRAWINGS

Further objects, features, and advantages of the present invention will become apparent upon consideration of the detailed description of the presently-preferred embodiments, when taken in conjunction with the accompanying drawings, wherein.

DETAILED DESCRIPTION OF THE PREFERRED EMBODIMENT OF THE INVENTION

Figure 1:
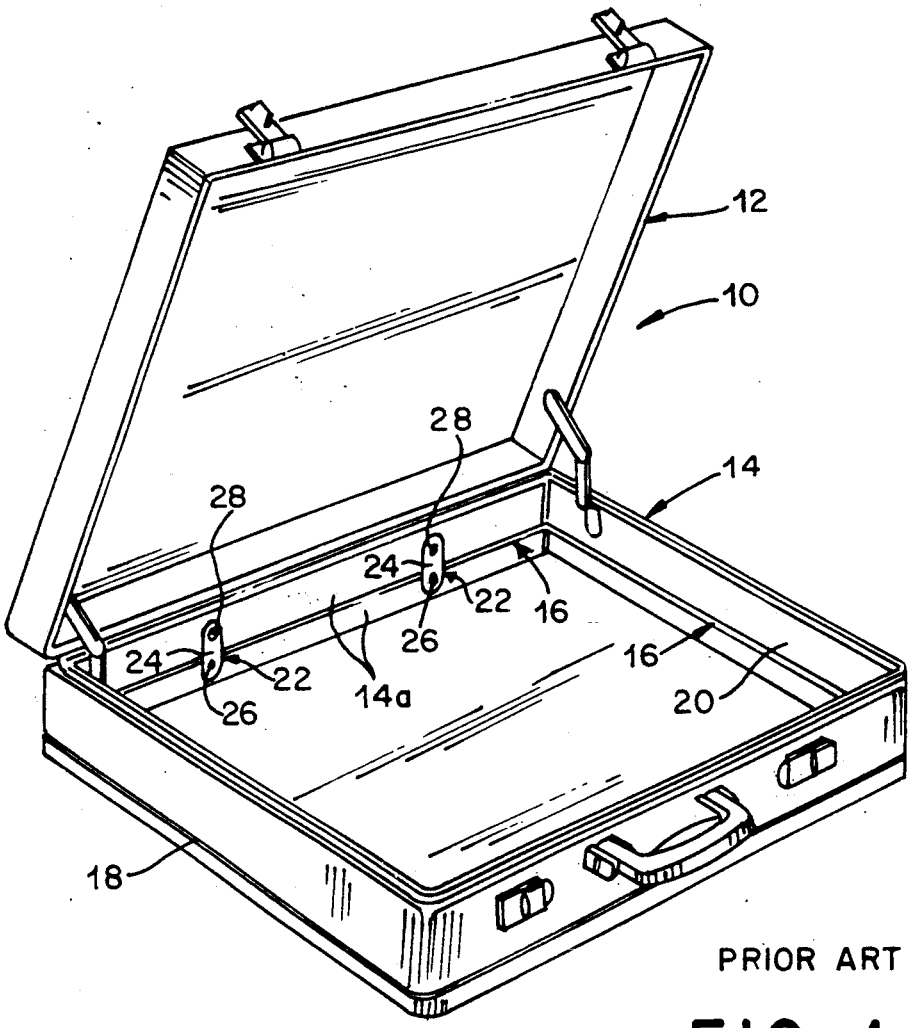
PRIOR ART FIG. 1
FIG. 1 is a perspective view of a prior art attache case including an expansion gusset.
Figure 2:
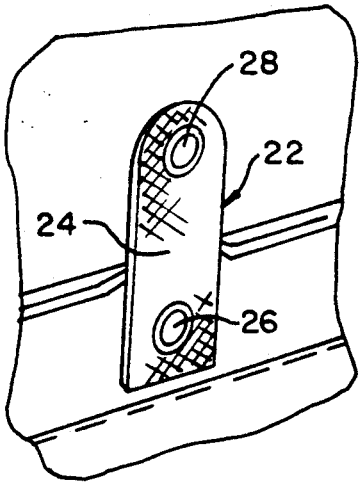
PRIOR ART FIG. 2
FIG. 2 is the embodiment of the prior art attache case shown in FIG. 1 wherein the elastic fastening means includes elastic straps and rivets.
Figure 3:
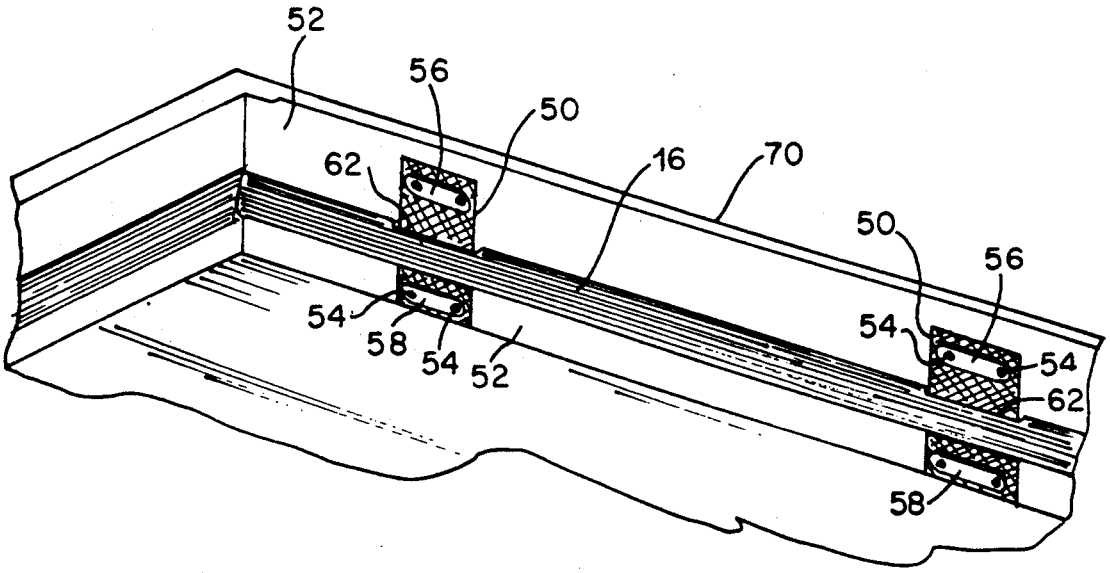
FIG. 3 is a perspective view of the present invention with the expansion gusset in a closed position showing the straps extending through the expansion gusset.
Figure 5:
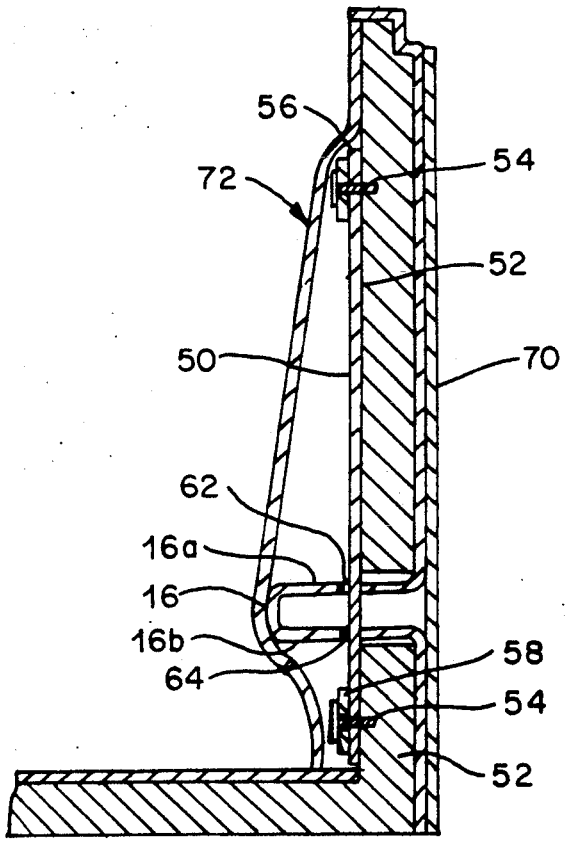
FIG. 5 is a cross section of the attache case as shown in FIG. 3.

Referring to FIGS. 3 and 5, the embodiments of the present invention are clearly illustrated. Straps 50 are preferably elastic and are formed of rubber, stretchable plastic polymers, or other suitable elastic materials. The fastening means that . keep each strap 50 in place include upper and lower fastener plates 56, 58, which may be fixedly or releasably attached to the interior wall 52 by standard rivets or snap fasteners 54 or other suitable fastening means. The fastener plates 56, 58 are typically made of a suitable metal or plastic or leather material. Other means of attaching the straps 50 to the interior wall 52 include screws, nails, staples, glue, epoxy cement, stitching, Or releasable fasteners. Alternatively, straps made of non-elastic materials, such as leather or other suitable materials, may be employed, instead of straps 50 being elastic.

The expansion gusset 16, shown in FIG. 5 in its closed position, forms a U-shaped member having upper leg 16*a* and lower leg 16*b*. The expansion gusset is typcially made of vinyl, leather, woven cloth, or any other similar material. Slots 62, 64 are formed in the expansion gusset 16 and are made by slits, cuts, or holes. In particular, slot 62 is formed in leg 16*a*, and slot 64 is formed in leg 16*b*. The integrity of these slots 62, 64 can be preserved by stitching around the slot to prevent ripping, tearing, and snaring of the slots 62, 64 by the elastic or non-elastic straps 50, as a result of prolonged and continued use of straps 50. Other methods of reinforcing slots 62, 64 include plastic or metal reinforcing guards which surround slots 62, 64.

Figure 6:
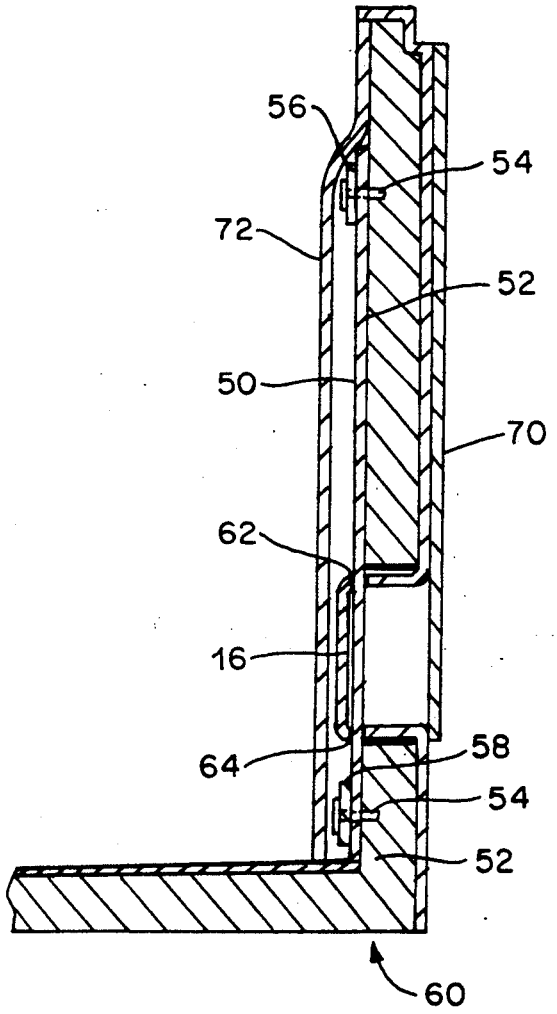
FIG. 6 is a cross section of the attache case as shown in FIG. 4.

As shown in FIGS. 5 and 6, the interior wall 52, the expansion gusset 16, rivets 54, and fastener plates 56, 58 are all covered with an interior lining 72. The interior lining 72 is held in place by glue or stitching and is typically made of vinyl, leather, woven cloth, or any other similar material. The interior lining 72 serves an aesthetic function providing the interior of the attache case with an uncluttered and neat appearance.

Each strap 50 extends through the expansion gusset 16 by means of the two slots 62, 64 which are formed in the expansion gusset 16 for each strap. In this manner, as gusset 16 is expanded, and when elastic straps 50 are employed, they are stretched and move relative to slots 62, 64 freely without interference or obstruction from the gusset 16.

Figure 4:
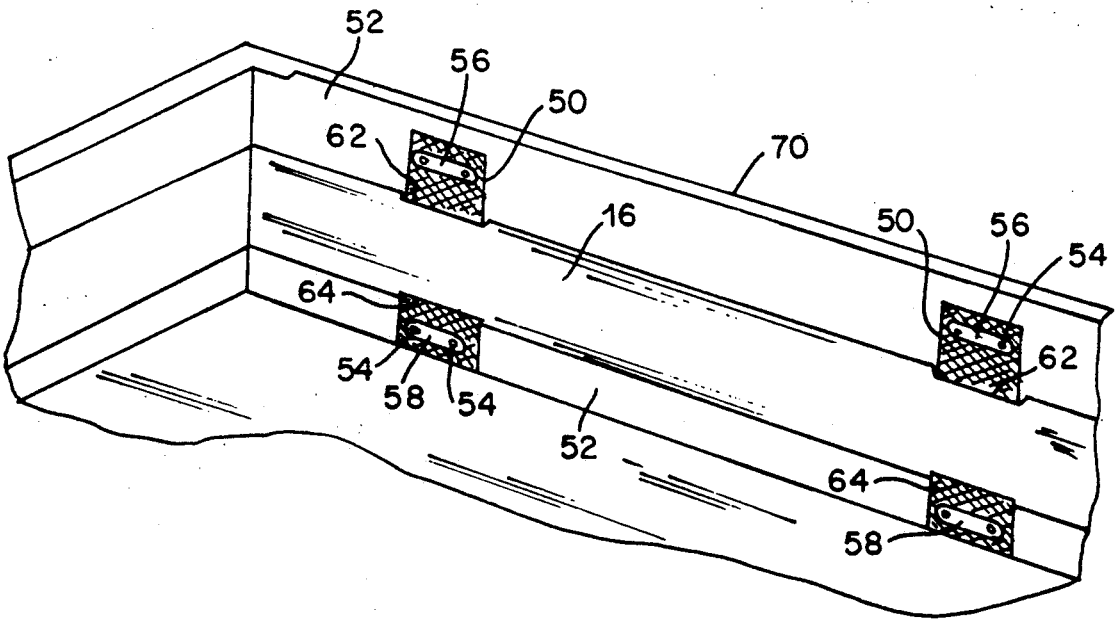
FIG. 4 is a perspective view of the present invention with the expansion gusset in a fully-expanded position showing the straps extending through the expansion gusset.

FIGS. 4 and 6 illustrate the fully-expanded position of the expansion gusset 16. This shows the elastic straps 50 having an elasticity at least equal to or greater than the distance which the expansion gusset 16 expands. When elastic straps 50 are extended through slots 62, 64 of the fully-expanded gusset 16, no undue force is applied to the fixed fastener plates 56, 58 and rivets 54 because the tension is taken up by the elastic straps.

In the embodiment described above, it should be understood that four elastic straps 50 are employed, two on each side of the case, similar to the locations of straps in conventional arrangements. However, the number of straps can be varied, if desired.

As shown in FIG. 6, this embodiment discloses the telescoping effect of the present invention. When the expansion gusset is closed or fully expanded, it cannot be seen because of an exterior wall 70. The movable section 60 of the attache case telescopes away from the base of the case and extends beyond the edge of the exterior wall 70 when the expansion gusset 16 is fully extended.

Figure 7:
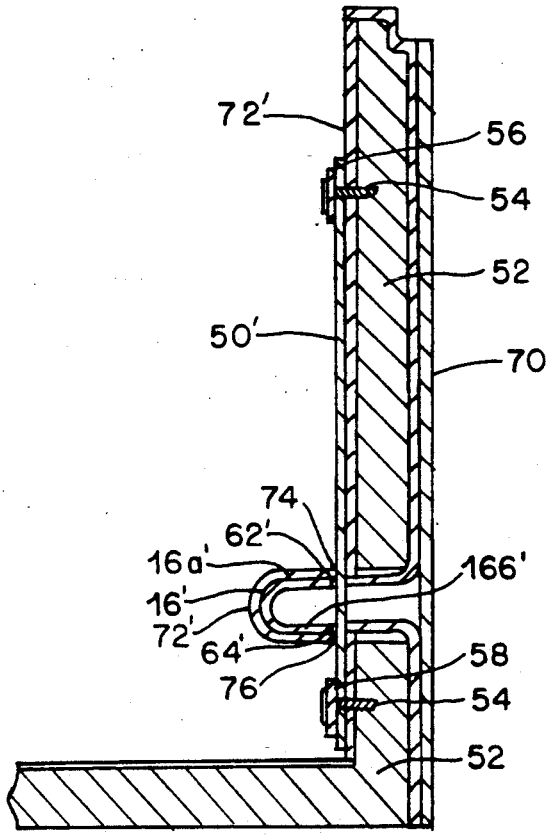
FIG. 7 is a cross-sectional view showing an alternative arrangement of the liner.

There is shown in FIG. 7 an alternative embodiment for the liner of the attache case. In this embodiment, primes have been added to the reference numerals to designate parts similar to those described in the first embodiment. In this embodiment, the straps 50' extend through slots formed in the liner. In particular, liner 72' is attached to the interior wall 52' of the attache case, and at the point where it meets gusset 16', the liner 72' extends around and covers the gusset. Slots 74 and 76 are formed in liner 72' in order for straps 50' to pass through liner 72, The slots 74 and 76 in liner 72' are formed at substantially the same location as slots 62' and 64' formed in gusset 16.

Advantageously, as a result of the present invention, there has been provided an improved fastening arrangement for use with expansion gussets which avoids the problems of the prior art. The elastic or non-elastic straps do not inhibit the free expansion and contraction of the expandable gusset because they extend through the gusset. Also, the elastic straps prevent undue forces from being applied to the fastening means.

A latitutde of modification, change, and substitution is intended in the foregoing disclosure, and in some instances, some features of the invention will be employed without a corresponding use of other features. For example, instead of employing vinyl for use as an expansion gusset, materials such as leather or woven cloth can be used. In another example, instead of employing rivets to hold the fastener plate to the interior wall, snap fasteners, wood screws, or corrugated nails, or stitching, or glue can be employed. Accordingly, it is appropriate that the appended claims be construed broadly and in a manner consistent with the spirit and scope of the invention herein.

What is claimed is:

1. An attache case, comprising:

first and second sections relatively movable with respect to each other for opening and closing said case;

at least one of said first and second sections including an expansion gusset having a movable section for expanding the capacity of said case, the movable section of said expansion gusset being movable between a closed position and an expanded position;

elastic straps extending across and through the movable section of said expansion gusset and including means for attaching said straps to the interior wall of the attache case; and the movable section of said expansion gusset having aligned slots through which said elastic straps extend.

2. The attache case of claim 1 wherein said movable section of said gusset is a U-shaped member having one slot formed in each leg thereof to form said aligned slots.

3. The attache case of claim 1 further including means for releasably attaching said elastic straps to said interior wall.

4. The attache case of claim 1 wherein said elastic straps are fixedly attached to said interior wall.

5. The attache case of claim 1 wherein said means is for releasably attaching at least one end of each of said elastic straps to said interior wall.

6. The attache case of claim 1 wherein said expansion gusset includes means for attaching said gusset to the outside wall of said attache case.

7. The attache case of claim 1 further including a liner, said liner having aligned slots formed therein through which said elastic straps extend, said liner slots being aligned with said gusset slots.

8. An attache case, comprising:

first and second sections relatively movable with respect to each other for opening and closing said case;

at least one of said first and second sections including an expansion gusset having a movable section for expanding the capacity of said case, the movable section of said expansion gusset being movable between a closed position and an expanded position;

non-elastic straps extending across and through the movable section of said expansion gusset and including means for attaching said straps to the interior wall of the attache case; and the movable section of said expansion gusset having aligned slots through which said non-elastic straps extend.

9. The attache case of claim 8 wherein said movable section of said gusset is a U-shaped member having one slot formed in each leg thereof to form said aligned slots.

10. The attache case of claim 8 further including means for releasably attaching said non-elastic straps to said interior wall.

11. The attache case of claim 8 wherein said means is for releasably attaching at least one end of each of said non-elastic straps to said interior wall.

12. The attache case of claim 8 wherein said expansion gusset includes means for attaching said gusset to the outside wall of said attache case.

13. The attache case of claim 8 further including a liner, said liner having aligned slots formed therein through which said non-elastic straps extend, said liner slots being aligned with said gusset slots.

* * * * *